US005277307A

United States Patent [19]

Kelly

[11] Patent Number: 5,277,307

[45] Date of Patent: Jan. 11, 1994

[54] GREETING CARD AND GIFT DISPLAY

[76] Inventor: Sherwin Kelly, Box 253 RR #1, South St., Clinton, N.Y. 13323

[21] Appl. No.: 956,289

[22] Filed: Oct. 5, 1992

[51] Int. Cl.[5] ..... B65D 5/64

[52] U.S. Cl. ..... 206/45.14; 217/63; 217/62

[58] Field of Search ..... 217/58, 59, 62, 63, 217/11; 206/45.28, 45.14, 45.15, 232

[56] References Cited

U.S. PATENT DOCUMENTS

| | | | |
|---|---|---|---|
| 173,360 | 2/1876 | Snider et al. | 217/63 |
| 210,345 | 11/1878 | Mayo et al. | 217/58 |
| 1,190,700 | 7/1916 | Appleton | 206/45.28 |
| 1,788,905 | 1/1931 | Barnes | 217/63 |
| 4,560,257 | 12/1985 | Otema | 217/11 |
| 4,746,009 | 5/1988 | Liberman | 206/45.15 |
| 4,967,953 | 11/1990 | Sugawara | 217/11 X |

FOREIGN PATENT DOCUMENTS

| | | | |
|---|---|---|---|
| 1110641 | 10/1955 | France | 217/63 |
| 5484 | 4/1915 | United Kingdom | 217/62 |
| 509172 | 7/1939 | United Kingdom | 206/45.28 |

*Primary Examiner*—William I. Price
*Attorney, Agent, or Firm*—Katherine McGuire

[57] ABSTRACT

In a representative embodiment of the invention, a display for a gift and greeting card or the like comprises a rigid box having an open front with a finished perimeter. A small gift may be removably positioned within the interior of the box with lighting means positioned adjacent thereto to selectively illuminate the gift. A reversible panel is slidingly movable in grooves formed in side frame members at the box open front to conceal and reveal the gift as desired. A multi-page greeting card may be positioned forwardly of the panel in the grooves with the back page thereof including a hole through which the panel, and subsequently the gift, may be viewed upon removal of the panel.

4 Claims, 5 Drawing Sheets

W
10
16
18
62
36
28
14
30
12
24
22
L
26

62
36
66
38
40
67
64
D
50
18
42
34
28
20
52
32
30
46
50
14
54
12
24
56
22
26
68
W'
W
76
80
82
84
74
78
85
72
70
71

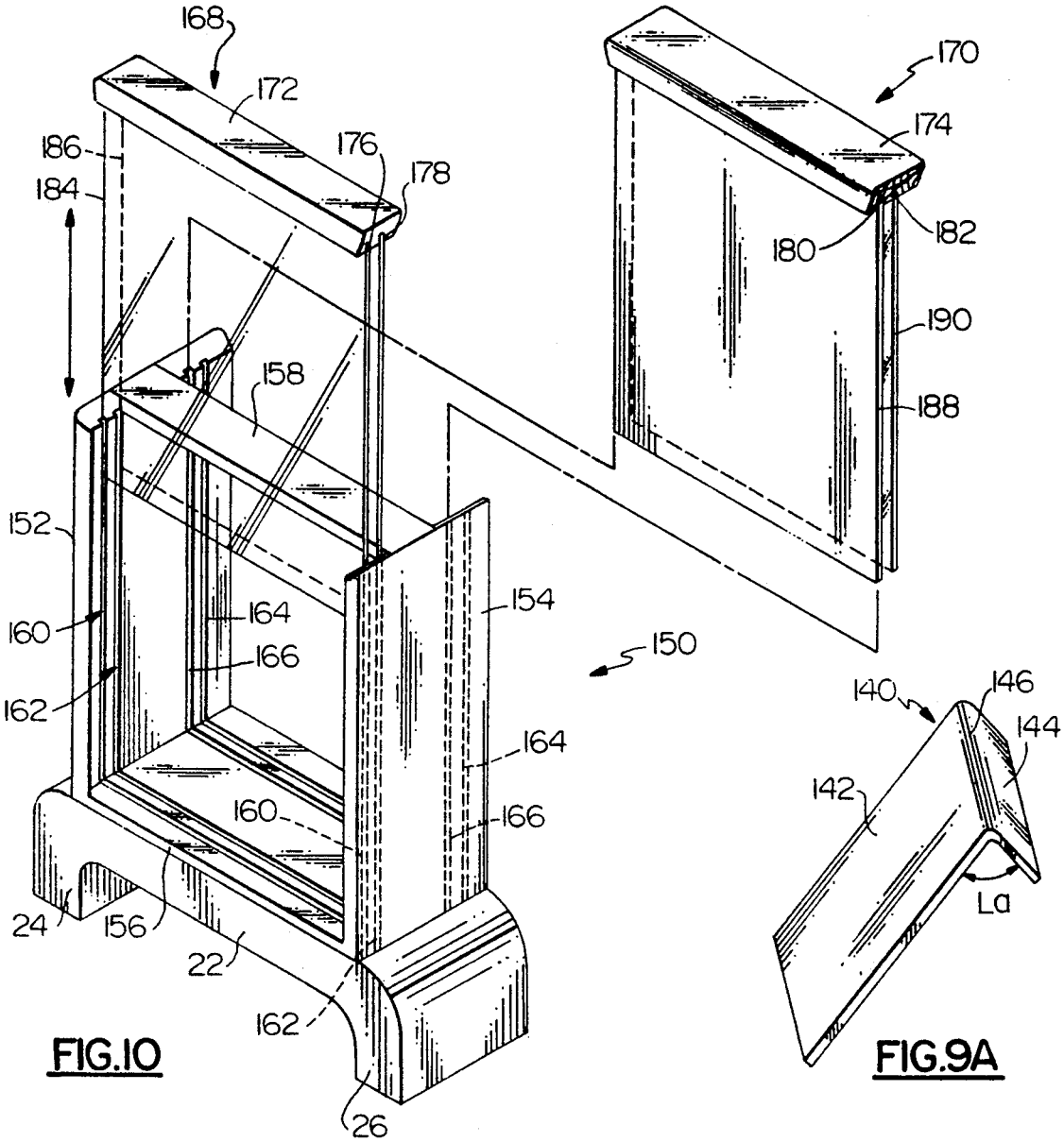
FIG.10
FIG.9A
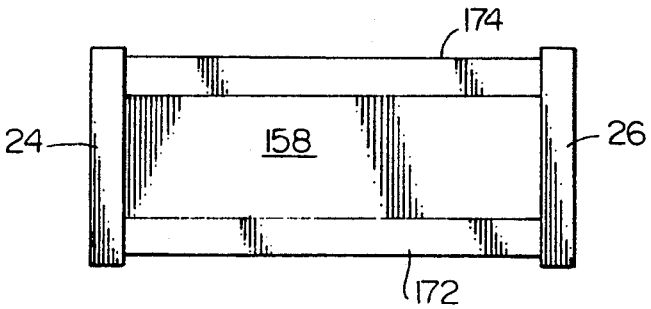
FIG.11

GREETING CARD AND GIFT DISPLAY

BACKGROUND OF THE INVENTION

This application relates to display apparatus for photographs, greeting cards and/or small gifts and, more particularly, to such apparatus which may be used in combination with attractive lighting means to display a variety of card arrangements in combination with a small gift, if desired.

Stylized frameworks for the attractive display of photographs, translucencies, cards and the like have been known for many years. It is also known to use a light in combination therewith to brighten the same with the light usually placed immediately behind the photograph, translucency, card and the like. It has also been the practice in the art to use illumination in a greeting card or storybook, and also with a gift such as a ring.

For example, U.S. Pat. No. 3,205,600 issued to Snyder on Sep. 14, 1965 discloses a framework for the display of a translucency including lighting means therebehind. The framework is formed from a pre-cut blank of cardboard or the like by folding upon a plurality of crease-lines and inserting tabs into respective slots integrally formed therein. A flanged backing plate is provided upon which the light fixtures are mounted for operation, being supplied electricity by an externally extending electric cord which is plugged into a conventional 110 V AC outlet.

To display the translucency, it is first applied to a rectangular frame which lies in covering relation to the perimeter of the translucency. The translucency and frame are then positioned against the backing plate and inserted into the larger, exterior framework to be displayed through the front opening thereof The lights on the backing plate shine through the translucency providing a bright picture for viewing through the framework.

Thus, while the Snyder display frame provides a lighted framework for a translucency, it is limited in that it must be disassembled to view a different translucency, and is not equipped for the display of anything other than a translucency. Also, the assembly of the outer framework could prove difficult for the elderly, especially if they have arthritis.

Another type of display frame for a translucency or transparency may be seen in U.S. Pat. No. 2,756,529 issued to Mazzocco on Jul. 31, 1956. The Mazzocco device also includes a light positioned between the back wall of the display and the transparency. The transparency must be folded along opposite side edges thereof to slidingly engage outwardly turned side flanges at the front of the backing member. The Mazzocco device is thus limited in the same respects as the Snyder device discussed above.

A combination greeting card and gift display may be seen in U.S. Pat. No. 4,840,275 issued to Faiola on Jun. 20, 1989. The Faiola device comprises a greeting card having a clear plastic container removably positioned in an opening formed in the front page thereof. A small gift such as the flower seen in the drawings is held and displayed to the receiver of the card through the plastic container, the flower being removably held within the container by means of wadding and tape affixed to the back portion thereof. The Faiola card is limited in that the size and configuration of the receptacle limits the choice of gift to be held therein.

A lighted jewelry box may be seen in U.S. Pat. No. 3,937,320 issued to Chao et al on Feb. 10, 1976. A light powered by a hidden battery is positioned within the top lid of a ring box and is directed to automatically impinge upon the ring upon lifting the lid open.

Lastly, a representative illuminated greeting card may be seen in U.S. Pat. No. 4,497,126 issued to Dejean on Feb. 5, 1985. The Dejean card comprises a two page folded card which includes a message imprinted on the inside surface of the front page thereof, and a three-dimensional, hollow, illuminated design affixed to the inside surface of the second page which faces the imprinted message on the first page. Means are provided to automatically activate the light within the 3-D design upon moving the first page away from the second page whereby the design illuminates the imprinted message.

The foregoing provides illustrative examples of the state of the art relating to picture and gift displays and greeting cards. It is seen that each is very limited in what may be displayed, e.g., a single transparency in Snyder and Mazzocco, a ring in Chao et al, and a message in Dejean. Thus, only a single design, gift or message may be displayed at any given time with the foregoing devices, and change between designs, gifts or messages requires dismantling of some units, and is not envisioned and impossible with others.

SUMMARY OF THE INVENTION

It is thus a principal object of the present invention to provide an apparatus which serves as a stylized display for a greeting card and gift which includes means to illuminate the gift held therein. A most important aspect to the principal embodiment of the invention is the provision of a multi-positional card and panel combination which may be selectively moved between several positions relative to each other and the outer frame to display a variety of messages and pictures, and further positioned to conceal or reveal the gift positioned therebehind within the frame as desired.

It is another object of the present invention to provide a display which includes lighting means positioned to illuminate a gift of one's choice deposited within the display.

It is a further object of the present invention to provide a display for a greeting card which includes a removable and reversible panel upon which at least two different messages and/or pictures may be mounted for alternate viewing of each as desired by the display by simply removing the panel from the display, rotating it 180° and inserting it back into the display.

It is yet another object of the present invention to provide a novel and unique display in the form of a standing box which may be used as a permanent memento to the receiver thereof.

It is yet a further object of the present invention to provide a display device for greeting cards, small gifts and other like memorabilia which is attractive to the eye, simple in construction, inexpensive to manufacture and is otherwise economically attractive.

Other object will in part be obvious and in part appear hereinafter.

In accordance with the foregoing objects, the present invention comprises a display apparatus for greeting cards, photographs, transparencies, small gifts and other like memorabilia. In a first embodiment of the invention the display comprises a generally rectangular framework having a back wall, two opposite side walls and a top wall forming a front opening wherein the above-mentioned memorabilia are positioned for viewing. The frame is fixedly mounted upon a base which forms the bottom wall of the upper frame and which is adapted to support the display in an upright position upon a planar surface such as a coffee table.

Grooves are longitudinally formed along the inner edges of the side walls which define the perimeter of the opening and extend forwardly of the top wall. A rigid panel may be slidingly and removably engaged within and between the grooves in the side walls with the panel thereby closing the front opening of the display. A covering of one's choice may be adhered to either surface of the panel whereby the panel may be reversed within the display to show the two different coverings thereon which may be a portion of a greeting card, photograph or other design and/or message.

Another portion of a greeting card which preferably compliments the covering on the panel may also be slidingly positioned within the grooves forwardly and in covering relation to the panel. This portion of the greeting card may be of single or multiple pages, with each successive page being revealed upon opening the previous page (immediately facing the viewer). The last page may include an opening wherethrough the covering on the panel is revealed.

Positioned within the display housing between the panel and the back wall of the display is a gift of one's choice which may be a ring or decorative egg with a message imprinted thereon, for example. Thus, the viewer/receiver may first open the front card to the last page which includes the opening revealing the covering on the panel and then proceed to lift the panel from the display which then reveals the gift positioned therebehind. Following removal of the gift, the panel may be slid back into place behind the card and the display kept as a personal memento.

Light means are also provided within the display housing and arranged to attractively illuminate the gift upon activating a switch mounted to the outer surface of the back wall.

In a second embodiment of the invention, the display comprises a generally rectangular box having a slidingly removable lid which accesses an interior for the deposit and presentation of a gift. The lid is reversible about the box for the selective display of different coverings mounted to either surface thereof. One of the surfaces may be left uncovered, if desired, and include a finished, leading edge which completes a finished perimeter of the box when the lid is in the fully closed position. Following receipt and removal of the gift held within the interior of the box, the lid may be reversed and replaced upon the box to display a message, photograph, or the like. An optional insert is provided which is removably positioned within the box providing a slanted surface upon which a stack of business cards may be placed for attractive presentation and display upon a desk.

In yet third and fourth embodiments of the invention, frameworks similar to the first embodiment are provided which include a plurality of grooves slidingly accepting removable card display inserts on both sides of the framework. The third and fourth embodiments are intended solely for the display of cards, photographs and the like and do not include means for illuminating the display nor the presentation of gifts.

BRIEF DESCRIPTION OF THE DRAWINGS

FIG. 9A is a perspective view of the insert seen in FIG. 9;

FIG. 10 is a perspective view of a third embodiment of the invention showing first and second panel inserts in fully removed and partially inserted positions with respect to the display frame, respectively;

FIG. 11 is a top plan view of FIG. 10 showing both panel inserts in the fully inserted position;

DETAILED DESCRIPTION

Figures 1, 2:
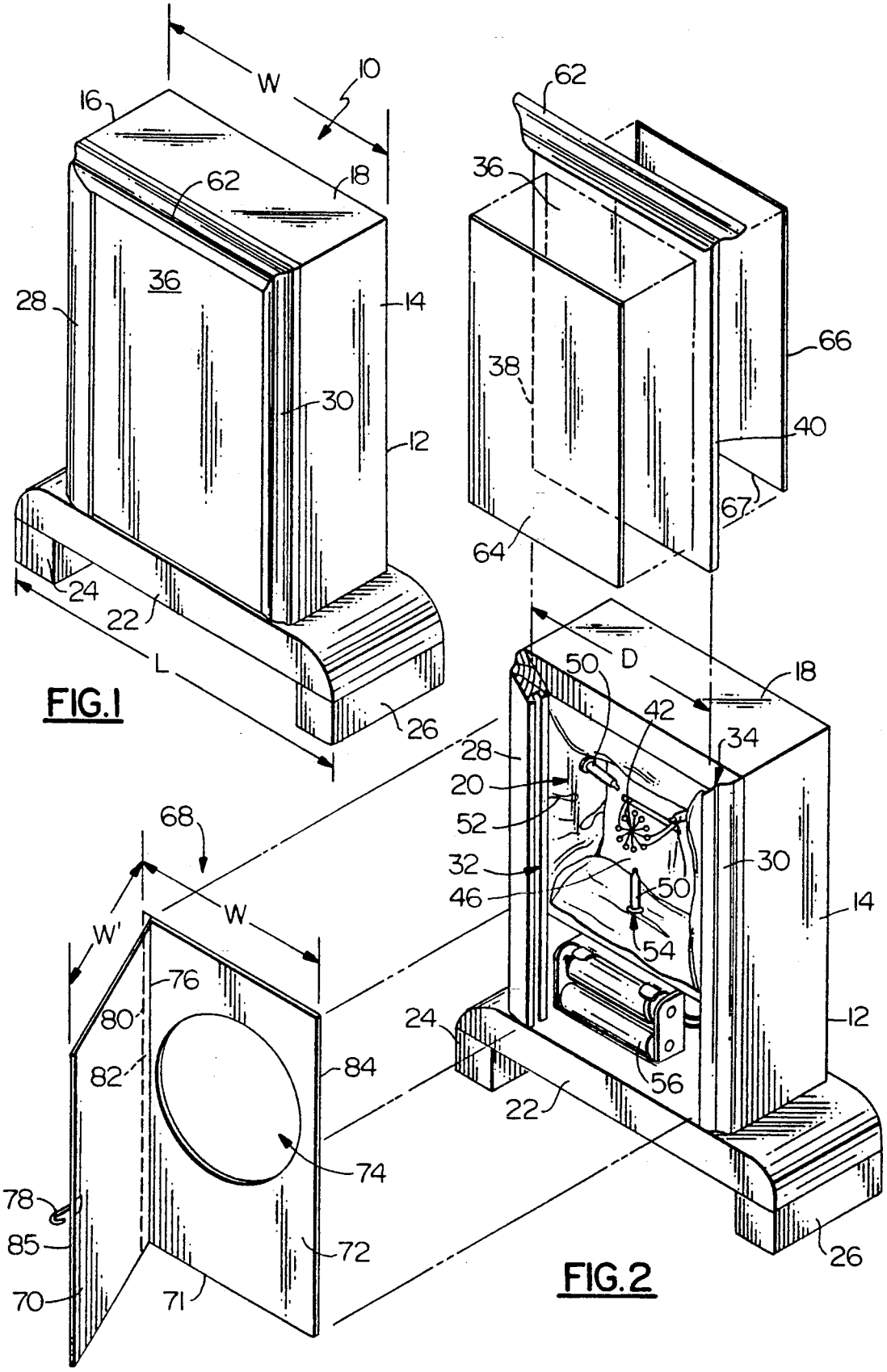
FIG. 1 is a perspective view of a first embodiment of the display apparatus showing the forward panel positioned in the fully inserted position in covering relation to the interior of the display.
FIG. 2 is the view of FIG. 1 showing the panel and coverings in spaced relation to and revealing the interior of the display frame, and further showing a two-page greeting card spaced forwardly therefrom.

Referring now to the drawings, there is seen in FIGS. 1–5 a first embodiment of the invention comprising a rectangular shaped display indicated generally by the reference numeral 10. Display 10 is made from a rigid material such as wood, metal or plastic, for example, and includes a back wall 12, opposite side walls 14 and 16 and top wall 18 defining an open front 20 of rectangular outline. Display 10 is fixedly mounted upon a base 22 including legs 24 and 26 provided on either end thereof, base 22 thereby forming a bottom wall with the upper framework of display 10. Legs 24 and 26 support display 10 upon any planar surface with back wall 12 lying in a plane substantially perpendicular to the surface upon which legs 24 and 26 are set. It will be noticed the length "l" of base 22 is longer than the width "w" of display 10 which provides enhanced stability thereof, as well as adding attractiveness to the overall design of display 10. It will be appreciated that other types of base supports may be affixed to display 10, or none at all.

First and second, elongated frame members 28 and 30 are integrally formed at the front edges of side walls 14 and 16 and include grooves 32 and 34, respectively, longitudinally extending along the inner surfaces thereof which face each other (only groove 32 being fully shown in the drawings). A panel 36 of rectangular outline is provided which is of approximately the same dimensions as back wall 12 of display 10. Panel 36 includes opposite side edges 38 and 40 which may be slidingly and removably received within grooves 32 and 34, respectively, of frame members 28 and 30. Panel 36 may thus be moved between a fully inserted position which completely covers opening 20 as seen in FIG. 1, and a fully withdrawn position which completely uncovers opening 20 ( FIG. 2). Panel 36 is furthermore reversible about display 10 to present either surface thereof to the viewer. In this regard, panel 36 is fully withdrawn from grooves 32 and 34, flipped over, and reinserted with side edge 38 being inserted in groove 34, and side edge 40 being inserted within groove 32.

Figure 5:
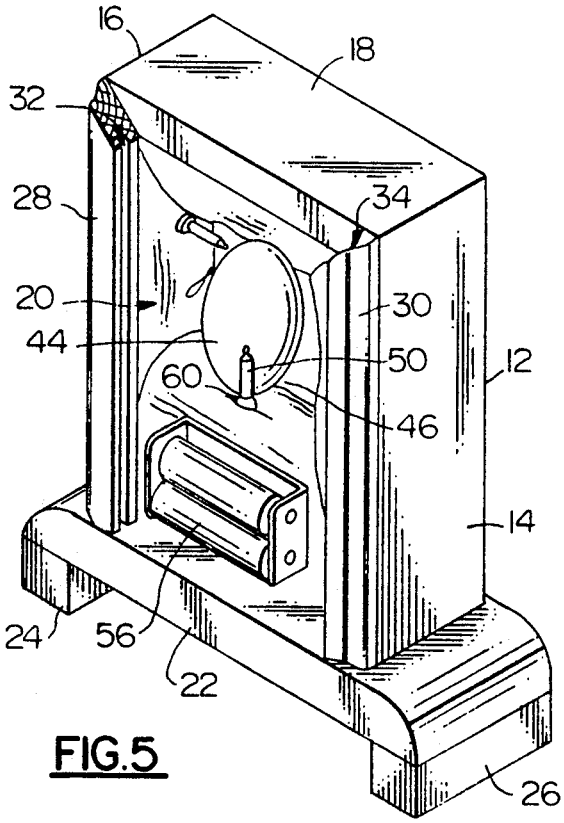
FIG. 5 is the view of FIG. 2 (absent the panel and greeting card) showing an egg with a message imprinted thereon positioned with the interior of the display in the intended manner.

Opening 20 of display 10 provides access to the interior thereof for the placement of a small gift such as a ring 42 seen in FIG. 2 or a decorative egg 44 as seen in FIG. 5. The gifts are held in place by a foam insert 46 which may be compressed between the inner surfaces of side walls 14 and 16 and thereby held in place by friction, or adhered to the inside surface of back wall 12 by glue or liquid cement, for example. Foam insert 46 includes a central opening wherein a ring holder 47 is positioned for removably receiving ring 42. In FIG. 5, foam insert 46 is likewise adapted to removably support and hold egg 44 within the interior of display 10 by being appropriately formed to support egg 44 in an upright position. Although a ring and egg are shown and described herein for purposes of description, it is understood that other small gifts may alternately be positioned within display 10 as desired, with foam insert 46 being appropriately formed to support the gift within display 10.

Light means are provided in the form of a plurality of small bulbs 50 arranged about the gift as desired to attractively illuminate the gift within display 10. A swath of material 52 of satin, silk, lace or the like may be placed over foam insert 46 to improve the attractiveness of the display, and may be secured by thread or other known means with bulbs 50 extending through small apertures formed in material 52 if desired such as aperture 54 seen in FIG. 2.

Figure 3:
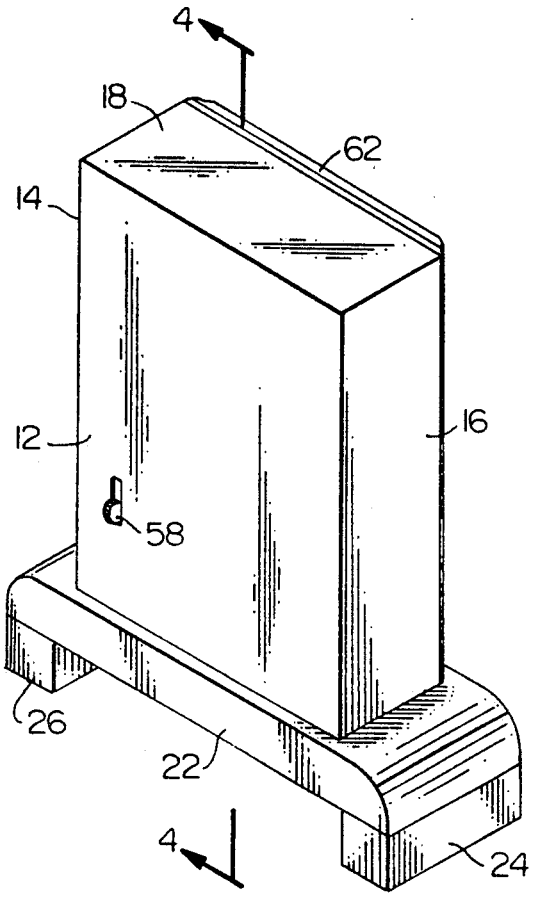
FIG. 3 is a perspective view of the back of the display of FIGS. 1 and 2.
Figure 4:
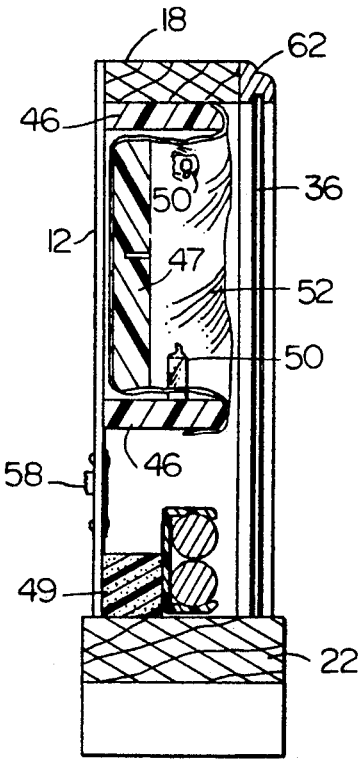
FIG. 4 is a cross-sectional view of the display as taken along the line 4—4 in FIG. 3.
Figure 6:
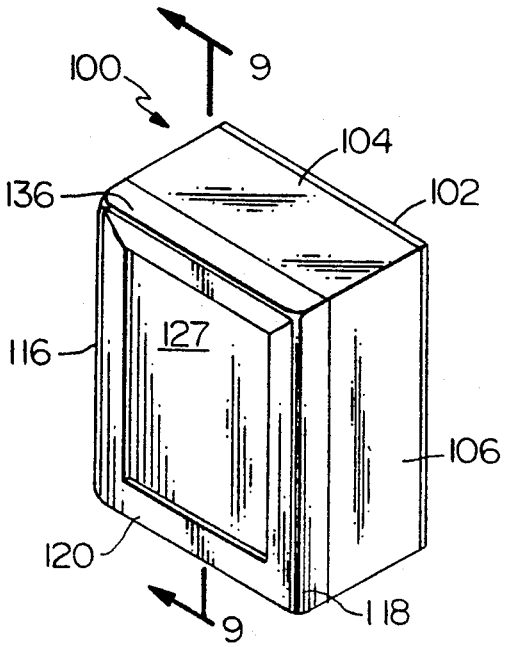
FIG. 6 is a front perspective view of a second embodiment of the invention in the general form of a rectangular box with removable lid, the lid being shown in the fully inserted position on the box.

Bulbs 50 are supplied electricity via batteries 56 which are positioned within the bottom half of opening 20 upon the inner surface of base 22. A piece of foam 49 may be positioned between batteries 56 and back wall 12 if desired as seen in FIG. 4. The bottom half of opening 20 containing batteries 56 is normally hidden from view by the removable elements of display 10 such as panel 36, for example, but may also be covered, if desired, by another swath of material or the like. As seen in FIGS. 3 and 4, a slide switch 58 is mounted to the exterior surface of back wall 12 and is operable to selectively activate bulbs 50 as desired.

As seen in FIG. 5, bulb 50 is positioned inside hollow egg 44 by being inserted through an aperture 60 formed at the base of egg 44 by known means. The shell of egg 44 is translucent and the light emitted by bulb 50 positioned therein shines through the shell to illuminate egg 44. A message may be imprinted upon egg 44 as seen in FIG. 5 which is illuminated internally, i.e., from behind the message which adds unusual attractiveness to the gift.

Referring to FIG. 2, panel 36 is seen to include a frame member 62 mounted to the top edge thereof which lies adjacent to top wall 18 of display 10 when in t he fully inserted position as seen in FIG. 1. The ends of frame member 62 are each mitered at a 45 degree angle to cooperatively engage like-mitered top ends of frame members 28 and 30, respectively, to form 90 degree corners therewith thereby completing a finished front perimeter of display 10.

Referring again to FIG. 2, panel 36 may include coverings 64 and 66 affixed to opposite surfaces thereof and in covering relation thereto. Coverings 64 and 66 may be in the form of a photograph or page from a greeting card, for example, with either covering 64 and 66 being displayed to the viewer as desired since panel 36 is reversible within display 10 as previously described.

A multi-page card may be positioned forwardly of panel 36 within display 10 such as the two-page card indicated generally by reference numeral 68. Card 68 is seen to include a front page 70 and back page 72 having a generally circular cut-out 74 formed therein. Front page 70 may be moved away from back page 72 about fold line 76. In this regard, a fabric loop 78 is seen attached adjacent the edge of front page 70 opposite fold line 76 for manually grasping and pulling loop 78, and thus front page 70, away from back page 72.

Thus, following insertion of panel 36 into display 10, card 68 may also be inserted within display 10 in grooves 32 and 34 in covering relation to and forwardly of panel 36. Card 68 is inserted in the completely folded or "closed" position with front page 70 lying in contacting, covering relation to back page 72. It will be noticed that fold line 76 lies parallel to and closely adjacent to the edges 80 of front and back pages 70 and 72, thereby defining an elongated strip 82 which is slidingly received within groove 32. Opposite edge 84 of back page 72 is slidingly received within its respective groove 34 with the width W of back page 72 being slightly smaller than the distance D between the facing inner surfaces of grooves 32 and 34 such that panel 36 may be quickly and easily inserted into and withdrawn from display 10 as described.

It will also be noticed that the width W' of front page 70 is slightly smaller than the corresponding width W of back page 72 so that the leading edge 85 of front page 70 does not fully engage groove 34. In this way, front page 70 may open in a direction away from back page 72 by pulling on fabric loop 78 when edges 80 and 84 are fully inserted within grooves 32 and 34, respectively.

It is intended that panel 36 be inserted within grooves 32 and 34 directly behind card 68. Since the back page 72 of card 68 has hole 74 formed therein, the covering (either covering 64 or 66) on panel 36 is visible therethrough upon opening front page 70 away from back page 72. As mentioned previously, the coverings may be a photograph or page from a greeting card, for example. In this regard, the covering on panel 36 is intended to compliment whatever design is on the card 68. If desired, a translucency may also be positioned over opening 74 in back page 72 (not shown).

The coverings 64 and 66 are intended to be permanently affixed to the opposite surfaces of panel 36 as previously described. It is also envisioned, however, that a translucency may be desired to be placed behind panel 36. Referring to FIG. 2, covering 66 may be a translucency which is removably positioned directly behind and in covering relation to panel 36 as shown. If desired, the bottom edge 67 thereof ma be integrally attached to the bottom edge 71 of back page 72 with panel 36 positioned therebetween.

The viewer is thus presented with display 10 and first pulls on loop 78 to open front page 70 in accordance with the directional arrow of FIG. 2. The covering on panel 36 facing back page 72 may then be viewed through hole 74. Without realizing there is more to the display 10, the giver proceeds to instruct the viewer to lift panel 36 from display 10 by pulling up on frame member 62. When panel 36 is completely removed from display 10, the viewer may see the gift held therein through hole 74 such as ring 42 or egg 44. The giver may activate lights 50 at any time by simply pushing on slide switch 58. Following removal of the gift, panel 36 may be replaced along with card 68 into display 10 between grooves 32 and 34 with either covering 64 or 66 being faced forwardly toward card 68.

Referring now to FIGS. 6–9, a second embodiment of the invention will now be described. A gift box 100 of generally rectangular or square configuration is provided having a bottom wall 102 with four side walls 104, 106, 108 and 110 extending therefrom to define an open top 112. The bottom wall 102 of gift box 100 is intended to rest upon a planar surface and includes felt spacers 114 positioned adjacent the four corners thereof to protect the surface upon which gift box 102 is laid.

Figure 7:
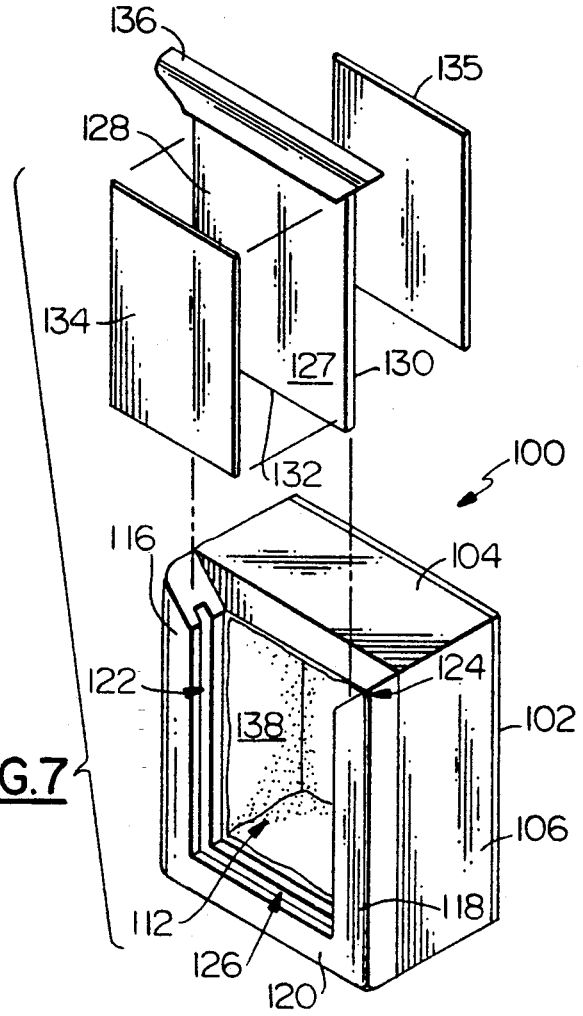
FIG. 7 is the view of FIG. 6 showing the lid and lid covering in spaced relation to the box.
Figure 8:
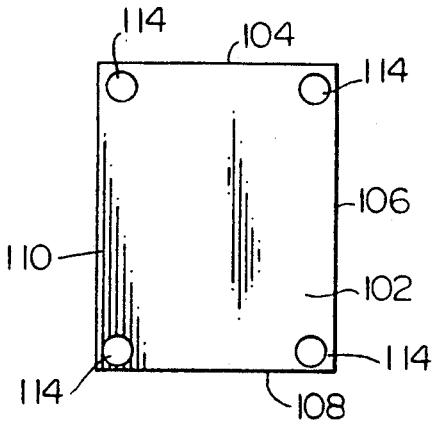
FIG. 8 is a bottom plan view of the box of FIGS. 6 and 7.

Three edges of gift box 100 include integrally formed frame members 116, 118 and 120 which include grooves 122, 124 and 126 longitudinally extending along the inwardly facing surfaces thereof as seen in FIG. 7, respectively. A panel 127 includes three edges 128, 130 and 132 which are slidingly received within grooves 122, 124 and 126, respectively, whereby panel 127 may be moved between a completely covering or uncovering position about opening 112. Coverings 134 and 135 may be affixed to the opposite surfaces of panel 127 with panel 127 being reversible within grooves 122, 124 and 126 in the same manner as panel 36 described previously in the first embodiment of the invention.

A fourth frame member 136 is attached to the top edge of panel 127 opposite edge 132 and completes the square, finished perimeter with frame members 116, 118 and 120 when panel 127 is in the fully engaged position within grooves 122, 124 and 126. The interior of gift box 100 may also be lined with a covering 138 of velvet or the like, if desired.

The interior of gift box 100 may contain and hold any small gift. The panel coverings 134 and 135 may comprise a greeting, photograph or other design of one's choice and be presented facing outwardly to the receiver. The frame members 116, 118, 120 and 136 present an attractive perimeter with the method of opening box 100 not being openly evident. In this way, the receiver may take slightly longer to open the gift box than normal which adds to the excitement of the gift-giving.

Figure 9:
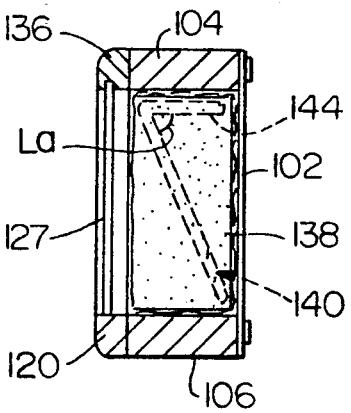
FIG. 9 is a cross-sectional view of the box as taken generally along the line 9—9 in FIG. 6, and further including an optional insert shown in dotted lines.

As seen in dotted outline in FIG. 9 and in perspective view in FIG. 9A, an optional insert 140 is provided having first and second walls 142 and 144 disposed at an acute angle a to each other along fold line 146. When inserted into box 100 as shown with insert wall 144 lying in covering relation to box wall 104, insert wall 142 forms a slanted interior bottom surface when bottom wall 102 is placed upon a planar surface with wall 142 extending from the top of side wall 104 to the bottom of opposite side wall 106. Insert 140 may be used to place a stack of business cards (not shown) thereon which are thus disposed at an angle within box 100 which facilitates manually picking the top card from the rest of the stack.

A third embodiment of the invention is seen in FIGS. 10 and 11 to comprise a display 150 having a rectangular framework including opposite side walls 152 and 154, bottom wall 156 and top wall 158. It will be noticed that top wall 158 is approximately half the width of side walls 152 and 154 and extends from substantially the center of the top edge of side wall 152 to the center of the top edge of side wall 154. Two pairs of grooves 160, 162 and 164, 166 contiguously extend on either side top wall 158 in the inner surfaces of side walls 152 and 154 and bottom wall 156. A pair of inserts 168 and 170 comprise elongated frame members 172 and 174 each having a pair of longitudinally extending, parallel grooves 176, 178 and 180, 182, respectively. Top edges of planar sheets 184, 186 and 188, 190 may be removably inserted within grooves 176, 178 and 180, 182 and may comprise photographs, greeting card or the like with the outwardly facing sheets 184 and 190 preferably being glass through which sheets 186 and 188 are visible, respectively. The side edges of each sheet 184, 186 and 188, 190 are removably inserted within grooves 160, 162 and 166, 164, respectively, in accordance with the directional arrows. When fully inserted (FIG. 11), frame members 172 and 174 lie flush with top wall 158.

It may thus be realized that display 150 provides a two-sided display for the viewing of photographs, greeting cards and the like which are removably and thus interchangeable within the grooves of frame members 172 and 174.

Figure 12:
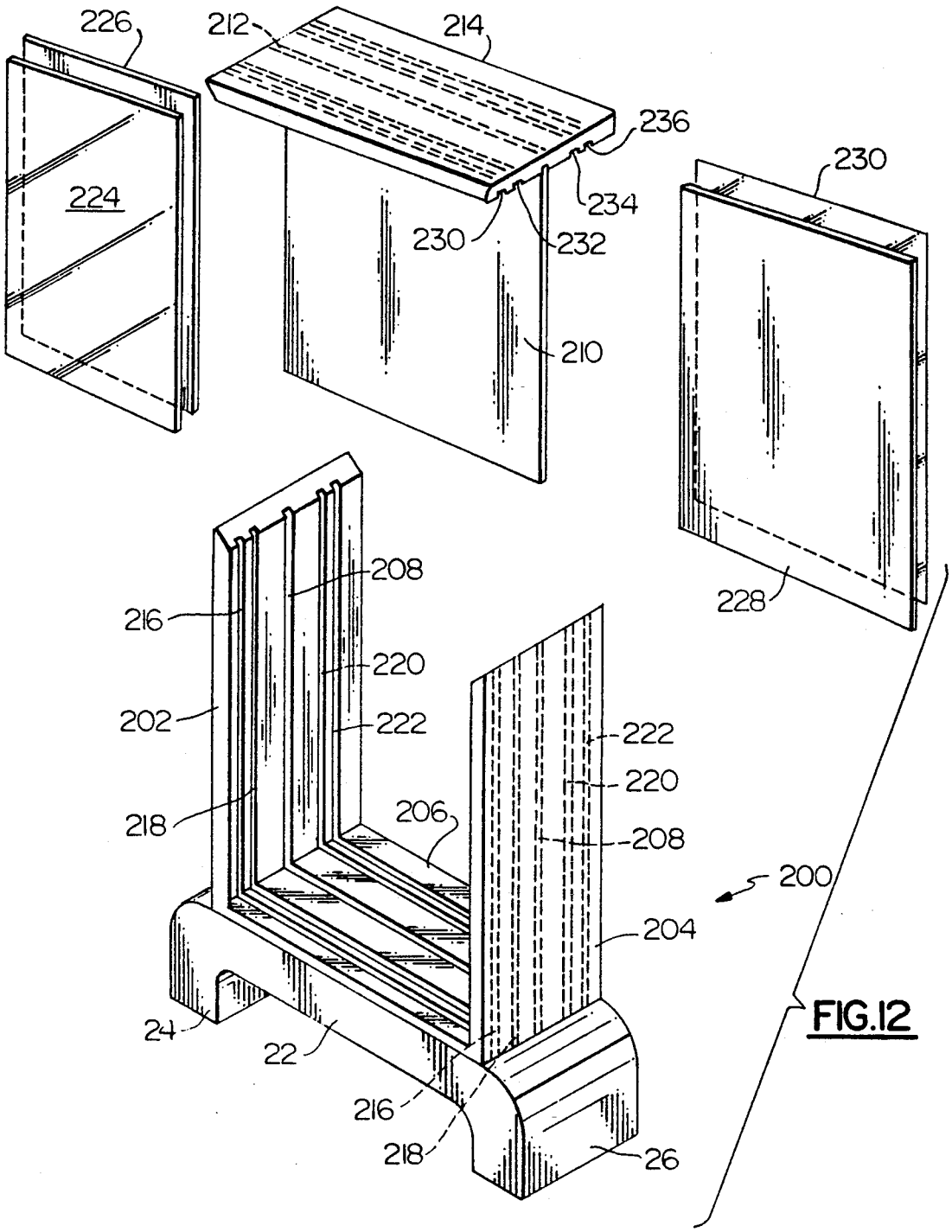
FIG. 12 is a perspective view of a fourth embodiment of the present invention showing all panel inserts in the fully removed position.
Figure 13:
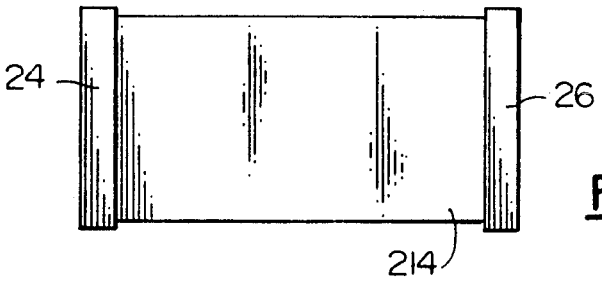
FIG. 13 is a top plan view of FIG. 12 showing the top wall in the fully inserted position.

Referring lastly to a fourth embodiment of the invention, attention is turned to FIGS. 12 and 13 which show a display 200 having a rectangular framework with opposite side walls 202 and 204, and a bottom wall 206 mounted in covering relation to base 22. A first groove 208 longitudinally and contiguously extends in substantially the center of side walls 202 and 204 and bottom wall 206. The bottom and opposite side edges of a rigid center panel 210 slidingly and removably engage in grooves 208 as shown by the directional arrows. The top edge of panel 210 fixedly secured within a center groove 212 in a top wall 214 from which panel 210 perpendicularly extends. The width of top wall 214 is substantially the same as the widths of side walls 202 and 204 whereby top wall 214 forms a rectangle of uniform width with side walls 202 and 204 and bottom wall 206 when in the fully inserted position (FIG. 13).

First and second pairs of parallel grooves 216, 218 and 220, 222 longitudinally and contiguously extend within side walls 202 and 204 and bottom wall 206 on opposite sides of center groove 208. First and second pairs of planar sheets 224, 226 and 228, 230 are removably and slidingly inserted within grooves 216, 218 and 220, 222, respectively, prior to insertion of panel 210 and top wall 214, and in accordance with the directional arrows. As with the third embodiment, outwardly facing sheets 224 and 230 are preferably glass wherethrough sheets 226 and 228 are visible, respectively, when in the fully inserted position. Sheets 226 and 228 may be photographs, greeting cards or the like. When sheets 224, 226 and 228, 230 are fully inserted within grooves 216, 218 and 220, 222, respectively, panel 210 is inserted within groove 208 to lie between and parallel to sheets 226 and 228 within display 200. The inner surface of top wall 214 is seen to include first and second pairs of grooves 230, 232 and 234, 236, respectively, which align with the top edges of sheets 224, 226 and 228, 230 when each are in the fully inserted position within display 200.

It will thus be appreciated that display 200 also provides a two-sided display for the viewing of photographs, greeting cards and the like which are removable and thus interchangeable in the same manner as the third embodiment of FIGS. 10 and 11.

What is claimed is:

1. A gift display and holder comprising:

a) a substantially rectangular box having a bottom and four side walls extending therefrom to form an open top;

b) first, second and third, elongated frame members integrally traversing the edges of three of said side walls, respectively, adjacent said open top, each of said frame members including a groove longitudinally formed and extending along the surfaces of said frame members located adjacent said open top and lying in planes perpendicular to said bottom wall;

c) a panel of substantially rectangular outline having three of four edges slidably movable within said grooves in said three side walls, respectively, said panel being movable between a fully inserted position completely covering said open top, and a fully withdrawn position separated from said box, said panel having first and second, opposite planar surfaces with said panel being reversible with respect to said box where either one of said first and second surfaces may be selectively positioned to face outwardly in a direction away from said box when said panel is moved to said inserted position; and d) a fourth elongated frame member attached to and traversing the fourth of said four edges of said panel, the ends of said frame members being mitered to form four 90° angles with each other when said panel is in said inserted position.

2. The invention according to claim 1 wherein at least one of said panel first and second surfaces includes a covering affixed thereto.

3. The invention according to claim 2 and further comprising a rigid insert having first and second walls lying in planes disposed at an acute angle to each other, said insert being removably positioned within said box interior with one of said first and second walls lying in covering relation to one of said box side walls, and the other of said one of said first and second walls extending from said front perimeter to said bottom wall.

4. The invention according to claim 3 and further comprising first and second coverings affixed to said panel first and second surfaces.

* * * * *